US009737768B2

(12) United States Patent
Miles et al.

(10) Patent No.: US 9,737,768 B2
(45) Date of Patent: Aug. 22, 2017

(54) GOLF PUTTER WITH CONSTRAINDED LIE ANGLE ADJUSTABILITY

(71) Applicant: Cue Golf Management, LLC, Greeley, CO (US)

(72) Inventors: John Norman Miles, St. Joseph, MO (US); Kent D. Heusinkveld, Loveland, CO (US); Eric M. Krug, Loveland, CO (US)

(73) Assignee: Cue Gold Management, LLC, Loveland, CO (US)

( * ) Notice: Subject to any disclaimer, the term of this patent is extended or adjusted under 35 U.S.C. 154(b) by 0 days.

(21) Appl. No.: 15/196,945

(22) Filed: Jun. 29, 2016

(65) Prior Publication Data

US 2016/0303438 A1 Oct. 20, 2016

Related U.S. Application Data

(62) Division of application No. 14/471,533, filed on Aug. 8, 2014, now Pat. No. 9,381,405.

(51) Int. Cl.

*A63B 53/02* (2015.01)
*A63B 53/00* (2015.01)
*A63B 53/04* (2015.01)

(52) U.S. Cl.

CPC ..... *A63B 53/02* (2013.01); *A63B 53/007* (2013.01); *A63B 53/0487* (2013.01); *A63B 2053/023* (2013.01); *A63B 2053/025* (2013.01); *A63B 2053/0433* (2013.01); *A63B 2053/0437* (2013.01)

(58) Field of Classification Search

CPC ... A63B 53/02; A63B 53/007; A63B 53/0487; A63B 2053/023; A63B 53/06; A63B 2053/0437; A63B 2053/0433; A63B 2053/025

See application file for complete search history.

(56) References Cited

U.S. PATENT DOCUMENTS 1,705,250 A 5/1927 Hincks
3,214,170 A * 10/1965 Warnock ..... A63B 53/007 273/126 A
5,244,205 A * 9/1993 Melanson ..... A63B 53/065 473/248
5,308,069 A 5/1994 Paquette
(Continued)

OTHER PUBLICATIONS

International Search Report for PCT Application No. PCT/US2015/047255, dated Nov. 24, 2015, 15 total pages.

*Primary Examiner* — Stephen Blau
(74) *Attorney, Agent, or Firm* — Paul M. Thompson; Cochran Freund & Young LLC

(57) ABSTRACT

Disclosed are systems and methods of adjusting the playing orientation of the head of a golf club. An adjustment to the axis of the shaft in reference to the vertical plane is constrained within minimum and maximum limits, so as to conform to current and proposed changes to the United States Golf Association (USGA) rules of play. The fine adjustment within these constraints cannot be readily made, and all adjustable parts are firmly fixed, so there is no reasonable likelihood of them working loose during a round. The adjustments to the club are designed such that during a stipulated round, the playing characteristics of a club cannot be purposely changed by adjustment or by other means.

13 Claims, 11 Drawing Sheets

(56) References Cited

U.S. PATENT DOCUMENTS

| | | | | |
|---|---|---|---|---|
| 5,340,104 | A | 8/1994 | Griffin | |
| 5,348,295 | A * | 9/1994 | Phillips | A63B 53/02 473/307 |
| 5,390,920 | A | 2/1995 | Nickum | |
| 5,407,196 | A | 4/1995 | Bussnardo | |
| 5,415,399 | A | 5/1995 | Kettelson | |
| 5,470,063 | A | 11/1995 | Fisher | |
| 5,511,779 | A | 4/1996 | Meyers et al. | |
| 5,533,730 | A | 7/1996 | Ruvang | |
| 5,577,726 | A | 11/1996 | Fenton | |
| 5,692,969 | A | 12/1997 | Schooler | |
| 5,730,661 | A | 3/1998 | Kozub | |
| 5,863,257 | A | 1/1999 | Busnardo | |
| 6,066,053 | A | 5/2000 | Sehemberger | |
| 6,126,555 | A | 10/2000 | Schooler | |
| 6,142,884 | A * | 11/2000 | Yim | A63B 53/02 473/248 |
| 6,203,443 | B1 | 3/2001 | Britton | |
| 6,270,422 | B1 | 8/2001 | Fisher | |
| 6,979,269 | B1 | 12/2005 | Nohara | |
| 7,070,515 | B1 | 7/2006 | Liu | |
| 7,172,513 | B1 | 2/2007 | Rinker | |
| 7,695,375 | B2 | 4/2010 | Kaczmarz et al. | |
| 7,695,376 | B2 | 4/2010 | Kaczmarz et al. | |
| 7,976,400 | B1 | 7/2011 | Pottorff | |
| 7,993,213 | B1 * | 8/2011 | D'Eath | A63B 53/02 473/288 |
| 9,272,193 | B1 * | 3/2016 | Yim | A63B 53/02 |
| 9,387,379 | B1 * | 7/2016 | Sanyal | A63B 53/14 |
| 9,427,638 | B2 * | 8/2016 | Sanyal | A63B 53/065 |
| 9,446,291 | B2 * | 9/2016 | Sanyal | A63B 53/02 |
| 2003/0195053 | A1 | 10/2003 | Cameron | |
| 2007/0111818 | A1 | 5/2007 | Pinder | |
| 2007/0298904 | A1 | 12/2007 | Dworzan | |
| 2008/0161121 | A1 | 7/2008 | Bitondo | |
| 2009/0137337 | A1 | 5/2009 | Shin | |
| 2011/0230275 | A1 | 9/2011 | Hicks | |
| 2012/0231896 | A1 | 9/2012 | Seluga et al. | |
| 2017/0036073 | A1 * | 2/2017 | Sanyal | A63B 53/02 |

* cited by examiner

GOLF PUTTER WITH CONSTRAINDED LIE ANGLE ADJUSTABILITY

CROSS-REFERENCE TO RELATED APPLICATION

This application is a divisional of U.S. patent application Ser. No. 14/471,533 entitled "Golf Putter with Constrained Adjustability" by John Norman Miles et al., filed Aug. 28, 2014. The entire content of the above listed application is hereby specifically incorporated by reference for all it discloses and teaches.

BACKGROUND OF THE INVENTION

Fixed angle, one piece golf clubs are the norm for golfers today, especially those players who compete in tournaments, which require strict adherence to the United States Golf Association (USGA) rules of play. The USGA provides governance for the game worldwide, jointly administering the Rules of Golf and establishing equipment standards. More specifically, the equipment standards, as they apply to golf clubs and putters in particular, are precise and rigid as to the size, shape, angle, material and method of use (stroke or swing). Thus, fixed parameter clubs have become the standard in nearly every tournament golfer's bag.

A golf club is defined as an implement designed to be used for striking the ball and generally comes in three forms: woods, irons and putters distinguished by shape and intended use. A putter is a club with a loft not exceeding ten degrees designed primarily for use on the putting green. Putters are permitted to have negative loft. However, a loft of less than −15 degrees would not be considered "traditional and customary in form and make" by the USGA. Additionally, the club must not be substantially different from the traditional and customary form and make, and must be composed of a shaft and a head. All parts must be fixed so that the club is one unit, and it must have no external attachments that affect the performance of the club.

This is interpreted to mean that no part of the golf club should be designed to move, nor should it be promoted as doing so. Therefore, if any part of a club were to incorporate moving powder, pellets, liquid, vibrating wires, rollers, tuning forks, or any number of other features which could be considered a "moving part," it would be in breach of this Rule. Additionally, this provision is interpreted to mean that with some exceptions, when assembled, all parts are bonded such that they require heating to loosen. Of course, this does not apply to clubs with permitted adjustable features.

The following requirements typically apply to all permissible methods of adjustment in a club: (i) the adjustment cannot be readily made; (ii) all adjustable parts are firmly fixed and there is no reasonable likelihood of them working loose during a round; and, (iii) all configurations of adjustment conform to the USGA Rules. During a stipulated round, the playing characteristics of a club must not be purposely changed by adjustment or by any other means.

In order to preserve the integrity of this Rule, it clearly states that it must not be too easy for a player to make adjustments during the course of a stipulated round. This is interpreted to mean that adjustments must require the use of a special tool, such as an Allen key, a Phillips screwdriver or a custom-made tool or device. It must not be possible to make the adjustment just by using the fingers, or some other object which would normally be kept in a golfer's pocket, such as a coin or a pitch-mark repair tool. The above restrictions have been included in the Rules in order to encourage the player to make all of the necessary adjustments to his clubs before starting his round, and to protect him from either unwittingly or purposely making adjustments during a round.

SUMMARY OF THE INVENTION

An embodiment of the present invention may therefore comprise: an adjustable golf club comprising: a golf club shaft; a clubhead comprising: a hollow body wherein a bottom surface of the body defines an upper boundary confine of a cavity with the hollow body, and a top surface of the body provides a crown with an opening disposed on the crown such that a proximal end of the club shaft may protrude through the opening; a retaining plate that attaches to the body wherein a top surface of the plate defines the lower boundary confine of a cavity with the hollow body, and a bottom surface of the plate provides a sole; a rocker member disposed within the cavity comprising: a cylindrical rocker pivot that allows the assembly to rotate about a pivot center; a toe rocker arm that extend forward from a pivot center; a heel rocker arm that extends rearward from the pivot center; and, a cylindrical bore that extends from a top portion into the rocker member to retain a distal end of the club shaft; wherein the confines of the cavity allow the rocker member limit single plane rotation about the pivot center constrained by interference between the rocker arms and the confines of the cavity at minimum and maximum angular limits; and, a lie adjustor that facilitates adjustment of the rotational position of the rocker member in a plane parallel to a striking face of the golf club within the constraints of the rocker arm interference and rigidly locks the rotation of the rocker member in place between the minimum and maximum angular limits.

An embodiment of the present invention may also comprise: an adjustable golf club comprising: a golf club shaft with a proximal grip and a distal end that is connected to a rocker member comprising one or more rocker arm protrusions, the rocker member that is confined within a cavity inside a hollow clubhead such that the rocker member may rotate within the cavity in a single plane parallel to a striking face of the golf club about a pivot center, the rotation that is limited to a constrained rotational arc, the angular limits of which are determined by the rocker arm protrusions that extend outwardly in the plane from the pivot center and interfere with the confines of the cavity at minimum and maximum angular limits; and, a lie adjustor that facilitates adjustment of the rotational position of the rocker member in a plane parallel to a striking face of the golf club within the constraints of the rocker arm interference and rigidly locks the rotation of the rocker member in place between the minimum and maximum angular limits.

An embodiment of the present invention may also comprise: an adjustable golf club comprising: a golf club shaft; a clubhead comprising: a hollow body comprising a crown with an opening disposed on the crown such that a proximal end of the club shaft may protrude through the opening; a retaining plate that attaches to the body wherein a top surface of the plate defines the lower boundary confine of a cavity with the hollow body, and a bottom surface of the plate provides a sole; a rocker member disposed within the cavity comprising: a semi-spherical rocker pivot that allows the assembly to rotate about a pivot center in 2 axis; a toe rocker arm that extend forward from a pivot center; a heel rocker arm that extends rearward from the pivot center; and, a pair of lateral rocker arms that extend laterally from a pivot center approximately perpendicular to the toe rocker arm and the heel rocker arm; a cylindrical bore that extends from a top portion into the rocker member to retain a distal end of the club shaft; wherein the confines of the cavity allow the rocker member limit 2-plane rotation about the pivot center constrained by interference between the rocker arms and the confines of the cavity; and, a lie adjustor that facilitates adjustment of the rotational position of the rocker member in a plane parallel to the striking face of the golf club within the constraints of the toe rocker arm and the heel rocker arm interference and locks the rotation of the rocker member in place with respect to the face plane; a loft adjustor that facilitates adjustment of the rotational position of the rocker member in a plane normal to the striking face of the golf club within the constraints of the lateral rocker arm interference and locks the rotation of the rocker member in place with respect to the normal plane.

An embodiment of the present invention may also comprise: adjustable golf club comprising: a golf club shaft with a proximal grip and a distal end that is connected to a rocker member comprising two or more rocker arm protrusions, the rocker member that is confined within a cavity inside a hollow clubhead such that the rocker member may rotate within the cavity in a first plane that is parallel to a striking face of the golf club about a pivot center and a second plane that is normal to the striking face about the pivot center, the face plane rotation that is limited to a constrained rotational arc, the angular limits of which are determined by the rocker arm protrusions that extend outwardly in the striking plane from the pivot center and interfere with the confines of the cavity at minimum and maximum angular lie limits; the normal plane rotation that is limited to a constrained rotational arc, the angular limits of which are determined by the rocker arm protrusions that extend laterally and normal to the striking plane from the pivot center and interfere with the confines of the cavity at minimum and maximum angular loft limits; and, a lie adjustor that facilitates adjustment of the rotational position of the rocker member in a plane parallel to the striking face of the golf club within the constraints of the toe rocker arm and the heel rocker arm interference and locks the rotation of the rocker member in place with respect to the face plane; a loft adjustor that facilitates adjustment of the rotational position of the rocker member in a plane normal to the striking face of the golf club within the constraints of the lateral rocker arm interference and locks the rotation of the rocker member in place with respect to the normal plane.

An embodiment of the present invention may also comprise: a method of adjusting the lie angle of a golf club comprising the steps: fixating a distal end of a golf club shaft having a proximal grip to a rocker member comprising one or more rocker arm protrusions; confining the rocker member inside a cavity within a hollow clubhead such that the rocker member may rotate within the cavity of the golf club about a pivot center; limiting the rotation to a constrained rotational arc between angular limits that are determined by the rocker arm protrusions that extend outwardly in the plane from the pivot center and interfere with the confines of the cavity at minimum and maximum angular limits; and, adjusting the angle of the shaft with respect to the clubhead by positioning the rocker member within the constraints of the rocker arm interference; and, rigidly locking the rotation of the rocker member in place between the minimum and maximum angular limits.

DETAILED DESCRIPTION OF THE INVENTION

Figure 1:
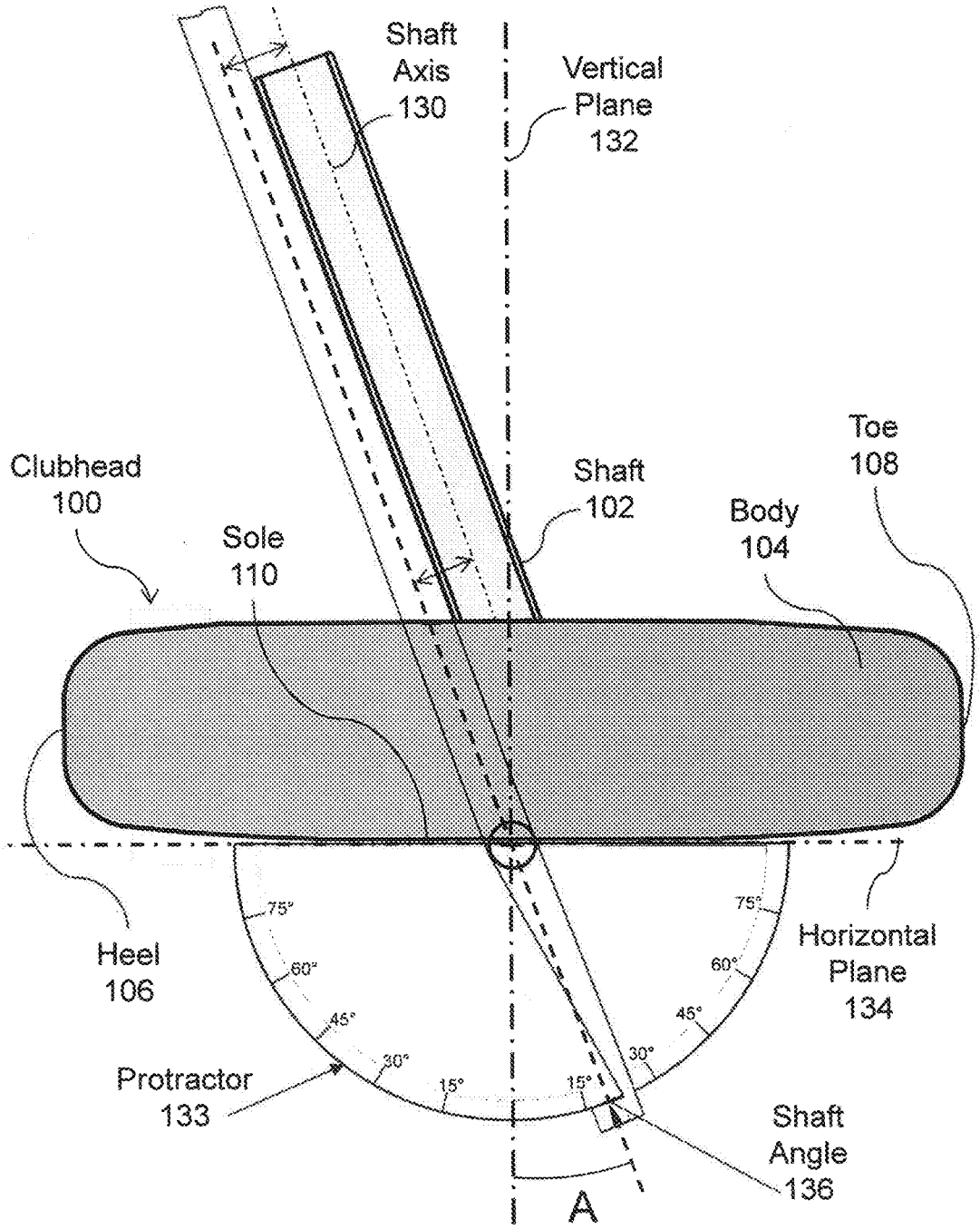
FIG. 1 illustrates a standard method measuring the shaft angle of a golf putter.

While this invention is susceptible to embodiment in many different forms, it is shown in the drawings, and will be described herein in detail, specific embodiments thereof with the understanding that the present disclosure is to be considered as an exemplification of the principles of the invention and is not to be limited to the specific embodiments described.

The disclosed apparatus overcomes the current limitations by presenting a putter that provides an adjustable head, in loft and/or lie, which still conforms to current and proposed USGA rules, thereby allowing it to be utilized in tournament play. The disclosed putter provides variable adjustment only within specific GSGA rule allowances and by specific intrinsic limits, and cannot be adjusted out of these specified limits. The adjustment that is allowed cannot be readily made and all adjustable parts are firmly fixed and there is no reasonable likelihood of them working loose during a round of golf. As shown and described herein, the disclosed adjustments to the putting club also do not allow the playing characteristics of the club to be purposely changed during a round. Thus, with the disclosed embodiments, the player is prevented from purposely modifying his club during the round, regardless of the adjustable design characteristics of the club.

FIG. 1 illustrates a standard method measuring the shaft angle of a golf putter and further illustrates the "normal address position" and depicts the determination of the shaft angle A 136, or lie, which is determined by the geometry of the clubhead 100 relative to the horizontal and the vertical plane 134 and 132 respectively. As shown in FIG. 1, the clubhead 100 is placed on a horizontal flat surface, with the sole 110 touching that surface at a point directly below the center of the face of the putter body 104. The shaft angle A 136 is measured with the clubhead 100 in this position utilizing a protractor 133 placed between the heel 106 and the toe 108 as described above. The shaft axis 130 of the shaft 102 is measured relative to the vertical plane 132.

Figure 2:
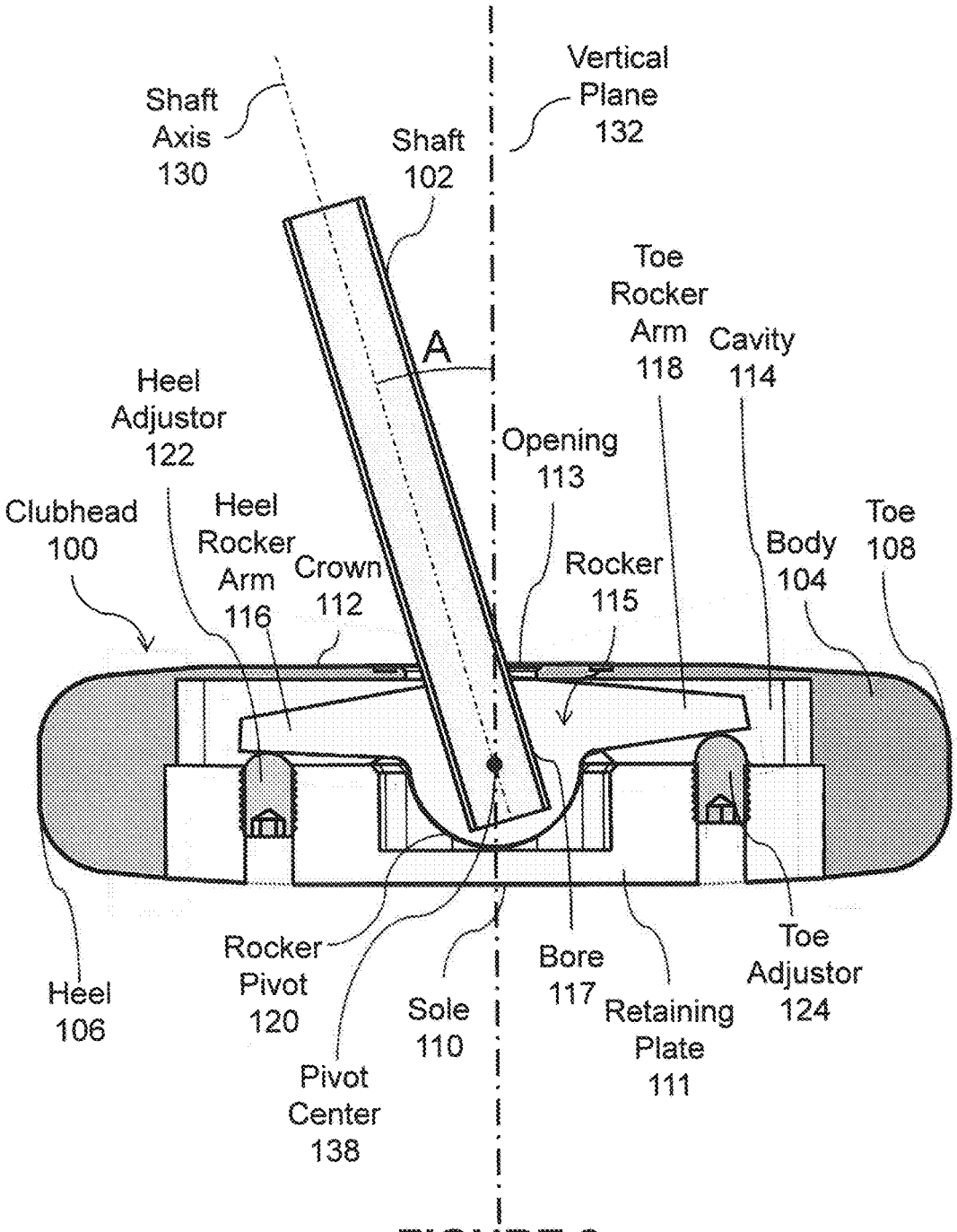
FIG. 2 illustrates an embodiment of a golf putter with constrained, single-axis adjustability of the shaft angle.

FIG. 2 illustrates an embodiment of a golf putter with constrained, single-axis adjustability of the shaft angle. As shown in a center cross-sectional sagittal view, the body 104 of a putter clubhead 100 is attached to a golf club shaft 102 oriented with the shaft axis 130 positioned at an angle A to the vertical plane 132. In this embodiment, the shaft is rigidly connected at its distal end to a rocker 115 utilizing a shaft receiving bore 117, and protrudes through the body 104 through an opening 113. The rocker 115 member in this embodiment comprises a rocker pivot 120 on its inferior side, and a pair of rocker arms that extend forward (towards the tow 108) and rearward (towards the heel 106) and may be utilized as cantilevers or lever arms to facilitate torque during adjustment, and to prevent torque when fixated or set into a locked (playing) position. The rocker pivot 120 has an approximately cylindrical profile (as shown) allowing the assembly to rotate about a pivot point (pivot center 138), thereby allowing adjustability of the shaft axis 130 to the vertical axis in a single plane of motion. The rocker 115 is sandwiched inside and between the body 104, on the upper surface of the cavity 114, and a retaining plate 111, on the lower rocker pivot surface.

The rocker 115 is constrained in its rotational limits by the pair of rocker arms 106, 108 that extend forward (heal 106) and rearward (toe 108). To reduce the shaft angle A, the pivot rocker 120 is rotated clockwise (in reference to FIG. 2) about the pivot center 138 and the toe rocker arm 118 moves toward the sole 110, while the heel rocker arm rotates toward the crown 112. The rotational limits of the pivot rocker 120 are determined by the internal geometry of the rocker arms 116, 118, protrusions from the central core of the rocker 115, and their interface with the internal surfaces of the body 104 in the cavity 114. As can be seen in FIG. 2, and is further demonstrated in FIG. 6, the minimum shaft angle A is achieved when the heel rocker arm 116 abuts against the inside upper surface of the cavity 114 (or any other rigid surface that may be contemplated to prevent further movement of the rocker arm) and is restricted from further movement.

Figure 5:
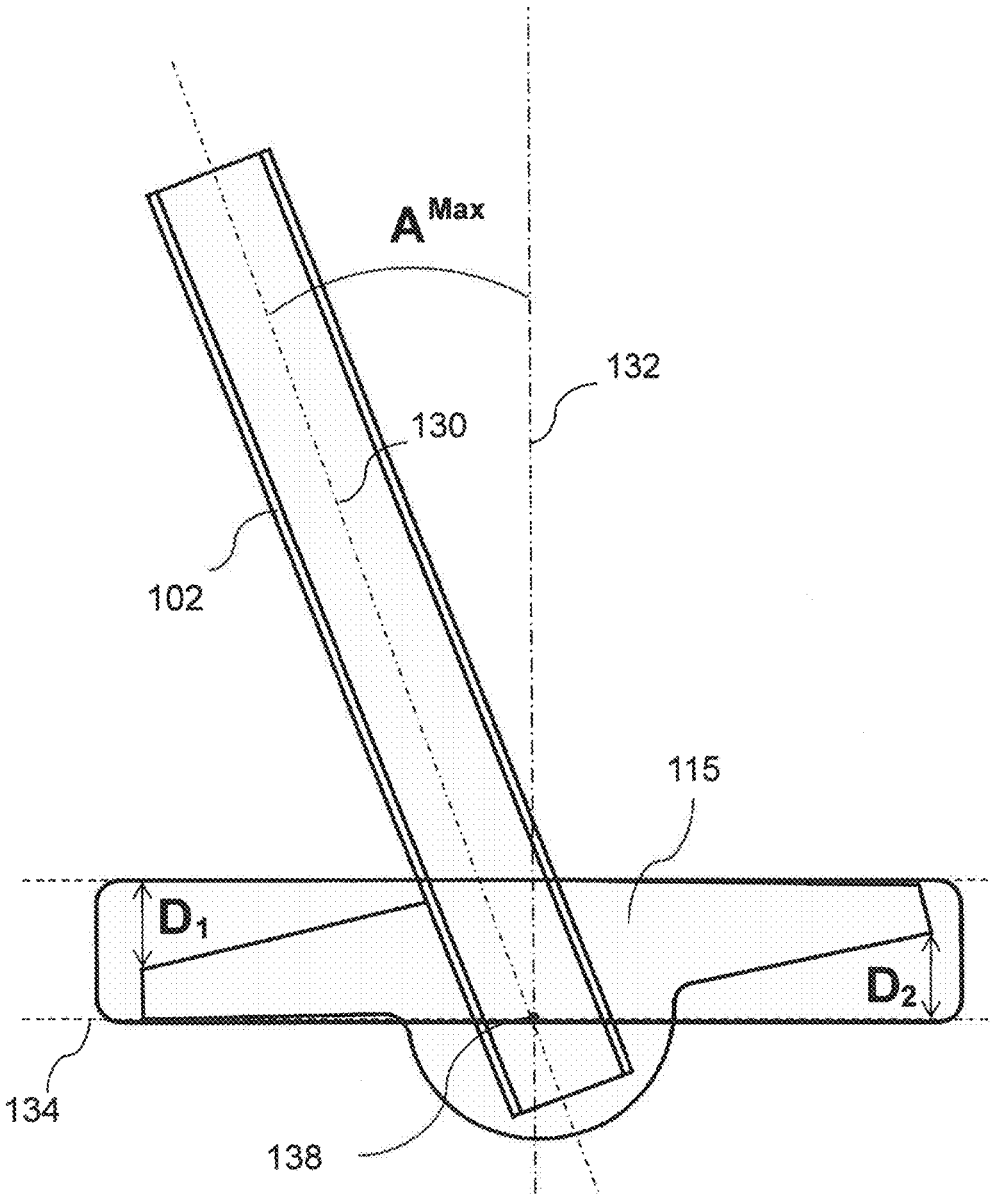
FIG. 5 illustrates the maximum shaft angle constraint for the single-axis adjustability of the shaft angle of a golf putter.

Similarly, as further demonstrated in FIG. 5, the maximum shaft angle A is achieved when the toe rocker arm 118 abuts against the inside upper surface of the cavity 114 (or any other rigid surface that may be contemplated to prevent further movement of the rocker arm) and is restricted from further movement. Thus minimum and maximum shaft angles A may be rigidly set by establishing these internal geometries while allowing complete variability within these limits. This variability in shaft angle A within strict limits, is facilitated with an adjusting mechanism, which takes the form in this embodiment of two adjusting set screws (bolts). By adjusting the position of the toe adjustor 124 and the heel adjustor 122, in this embodiment a pair of hex head set screws, the exact shaft angle A (within specific min and max limits) may be set for a particular user of the club.

Figure 3:
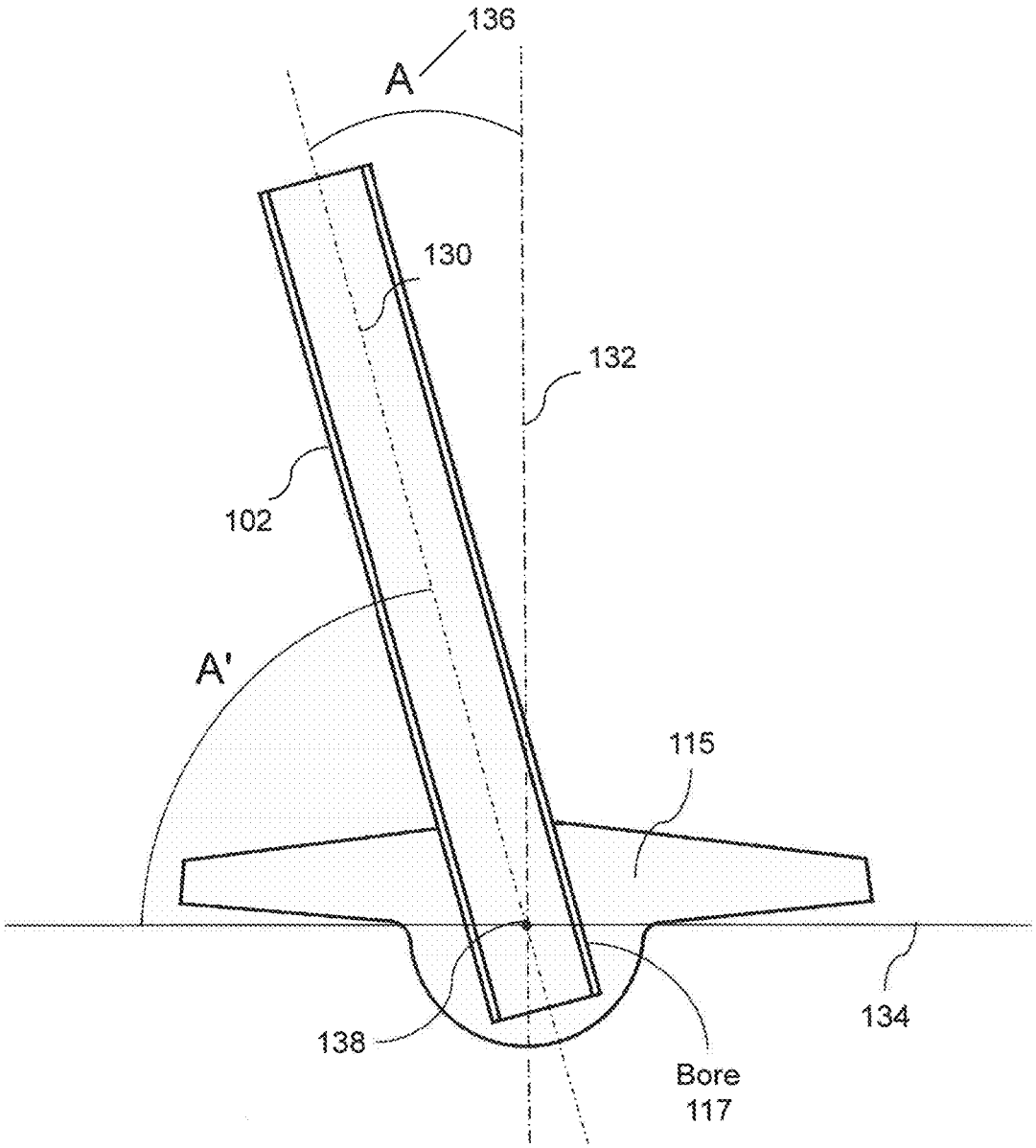
FIG. 3 illustrates an embodiment of a member that facilitates constrained, single-axis adjustability of the shaft angle of a golf putter.

FIG. 3 illustrates an embodiment of a member that facilitates constrained, single-axis adjustability of the shaft angle of a golf putter shaft 102 constrained within a rocker 115 assembly. As shown in a center cross-sectional sagittal view, the shaft may be affixed to the rocker 115 in any manner such as welded, press fit, threaded, bonded or the like. As shown in FIG. 3, the shaft angle A 136 is measured from the vertical plane 132, and an opposing angle A' is the converse of this angle, and measures the angle from the shaft 102 to the ground or horizontal plane 134.

Figure 4:
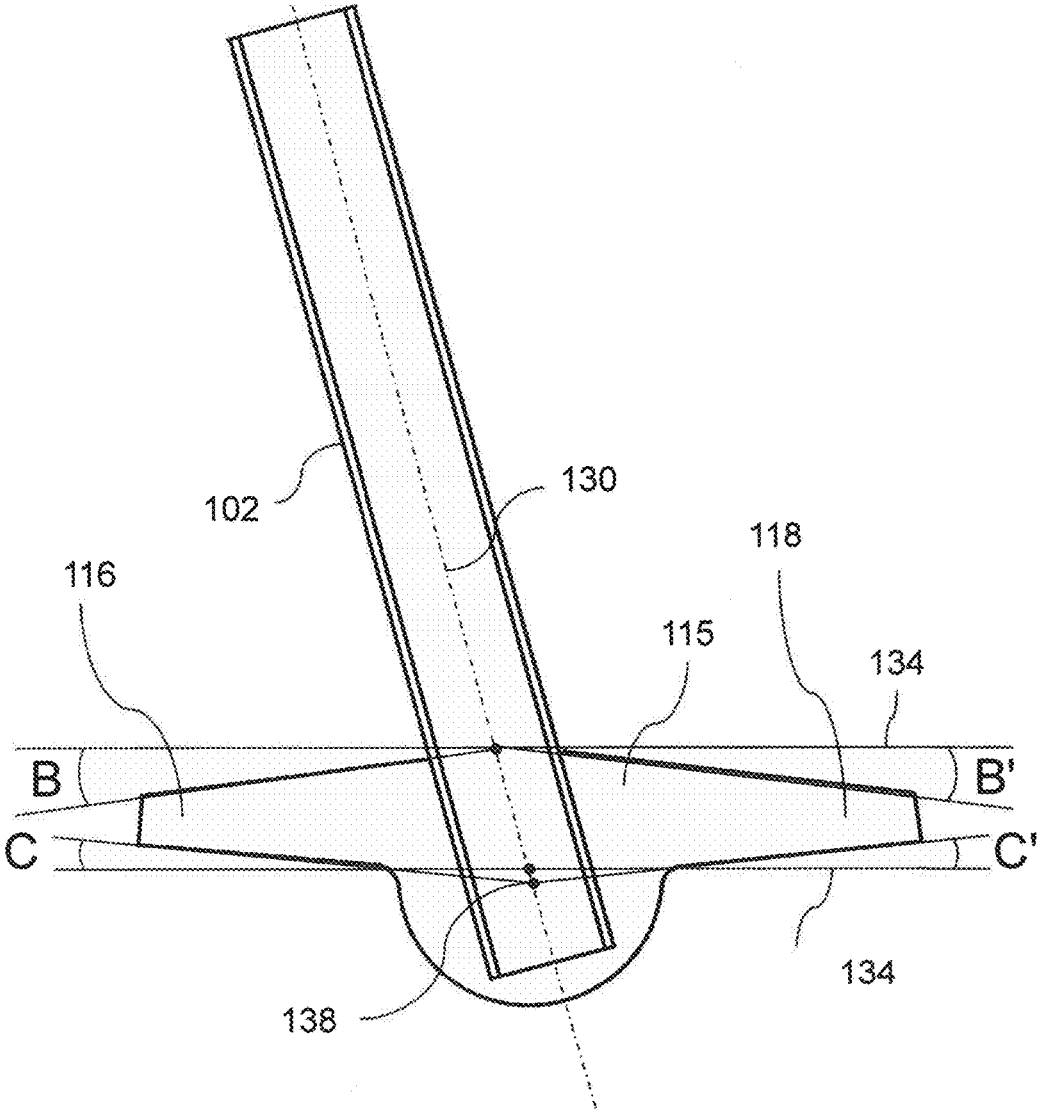
FIG. 4 illustrates the constrained adjustment angles of a member that facilitates single-axis adjustability of the shaft angle of a golf putter.

As described above, the rotational limits (Constrained adjustability) of the pivot rocker 120 are determined by the internal geometry of the rocker arms 116, 118 and their interface with the internal surfaces of the cavity 114. FIG. 4 illustrates the constrained adjustment angles of a member that facilitates single-axis adjustability of the shaft angle of a golf putter. In this example, the upper surface of the heel rocker arm 116 is offset from the horizontal 134 by angle B. Similarly, the upper surface of the toe rocker arm 118 is offset from the horizontal 134 by an angle B'. Additionally, the lower surfaces of the rocker arms 116, 118 are offset from the horizontal 134 by angles C and C' respectively. In this embodiment, these offset angles set minimum and maximum angles for the adjustment of the putter shaft 102. In this way fluid and unlimited adjustment is possible within rigid constraints.

For example, B and B' may be the same angle providing equal boundaries between the center set point, or they may be different, providing a unique boundary angle about a center point. Angles B and B' may utilize the top surface of the cavity 114 to limit rotation of the rocker 115 about the pivot center, while angles C and C' may utilize the uppermost surface of the adjustors 122, 124 to fixate the rocker 115 in position.

Figure 6:
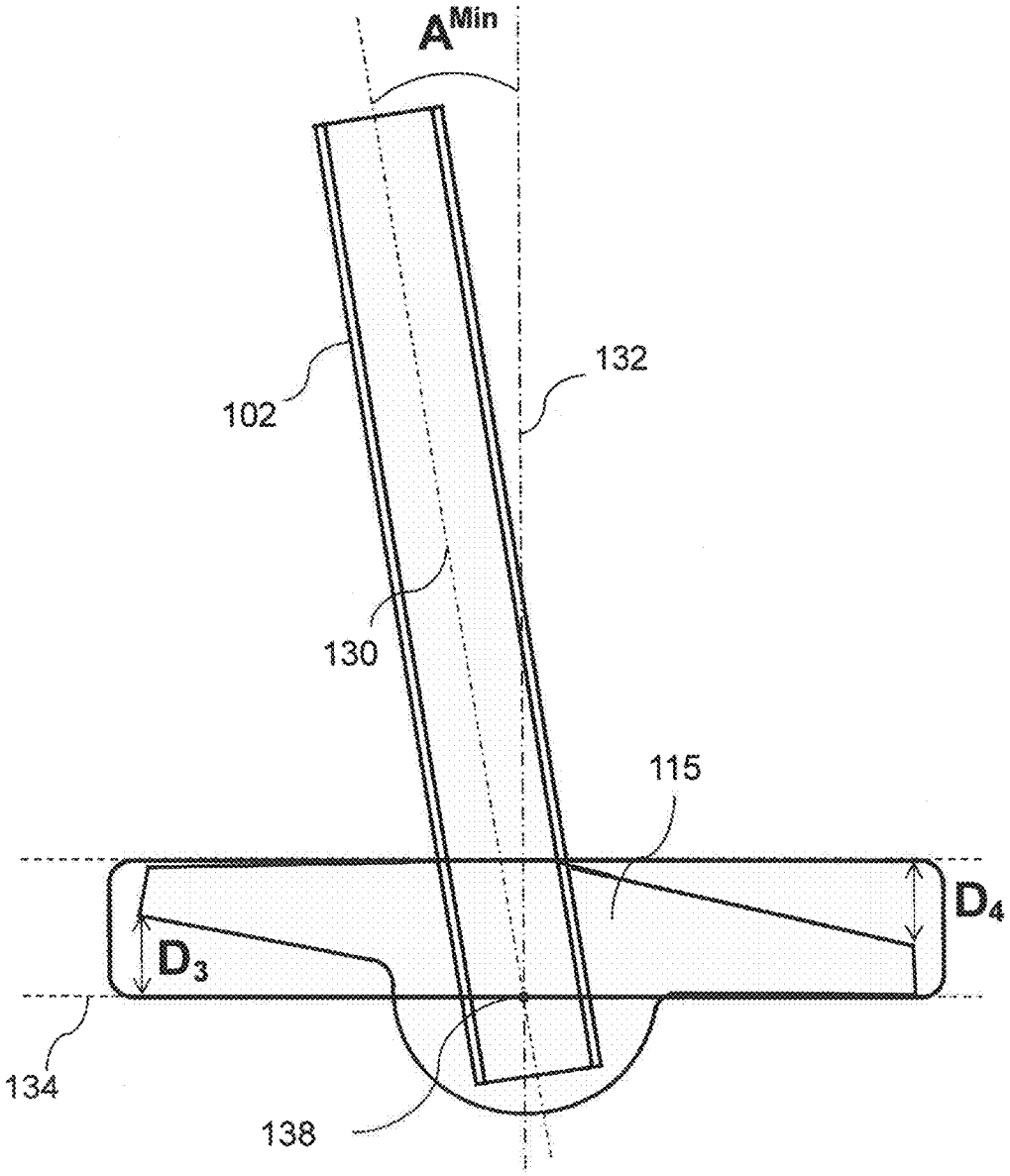
FIG. 6 illustrates the minimum shaft angle constraint for the single-axis adjustability of the shaft angle of a golf putter.

FIG. 5 illustrates the maximum shaft angle constraint for the single-axis adjustability of the shaft angle of a golf putter. As described above, the maximum allowable angle $A^{Max}$ available with the putter assembly is achieved when the rocker 115 is rotated to a point where B' is approximately zero, and the upper face of the toe rocker arm 118 is in contact with the upper inner surface of the cavity 114. This condition is depicted in FIG. 5 and shows distances $D_1$ and $D_2$ maximized. Conversely, FIG. 6 illustrates the minimum shaft angle constraint for the single-axis adjustability of the shaft angle of a golf putter. The minimum allowable angle $A^{Min}$ available with the putter assembly, is achieved when the rocker 115 is rotated to a point where B is approximately zero, and the upper face of the heel rocker arm 116 is in contact with the upper inner surface of the cavity 114. This condition is depicted in FIG. 6 and shows distances $D_3$ and $D_4$ maximized.

Figure 7:
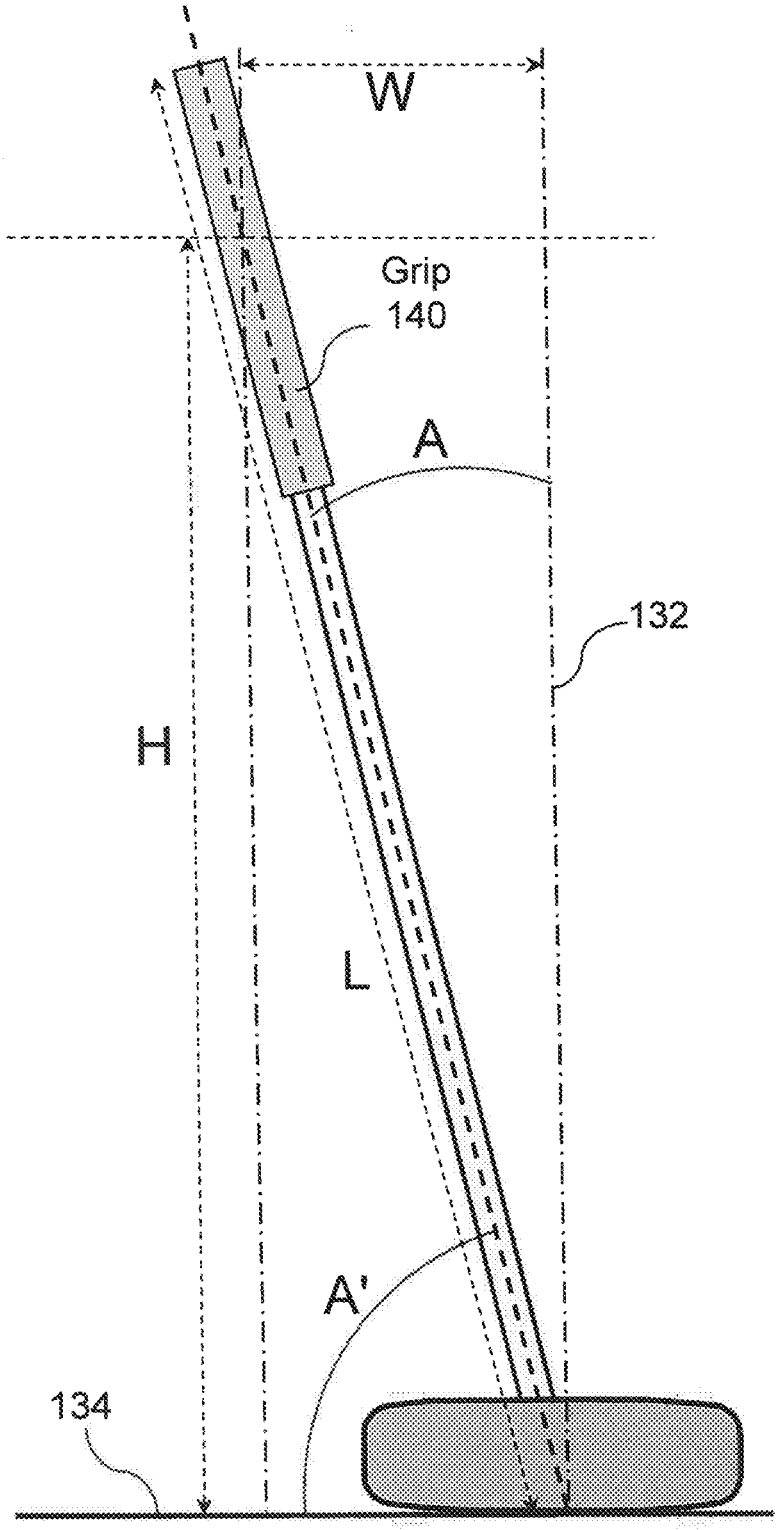
FIG. 7 illustrates the geometries involved for an embodiment of a golf putter with constrained, single-axis adjustability of the shaft angle.

With the minimum and maximum shaft angles determined by clubhead 100 geometry, and assuming that these angles fall within the USGA rules, the fine adjustment that tailors the club to the individual anthropomology of the user facilitates an adjustable club that is legal for USGA tournament play. FIG. 7 illustrates the geometries involved for an embodiment of a golf putter with constrained, single-axis adjustability of the shaft angle. As illustrated in FIG. 7, specific features of the club may be tailored to the individual user. With slight variations to the shaft angle A, the club grip height H and the distance W from the grip point on the grip 140 to the clubhead 100, may be easily varied. This, along with potential variations in shaft length, provide for a club that may be used in a variety of swing and grip positions and easily facilitates a comfortable and precise adjustment to non-anchored putting strokes.

Thus, a short or smaller person may desire a large shaft angle 136 in order to keep the sole of the clubhead 100 flat against the surface of the putting green (parallel to the horizontal plane 134), while a taller person or someone who is using a long style putter may desire a small shaft angle 136 in order to keep the sole of the clubhead 100 flat against the surface of the putting green. In any instance, the disclosed embodiments offer the maximum adjustability within the limits of the geometry, and more specifically can be tailored to provide this maximum adjustment within USGA rules.

Figure 8:
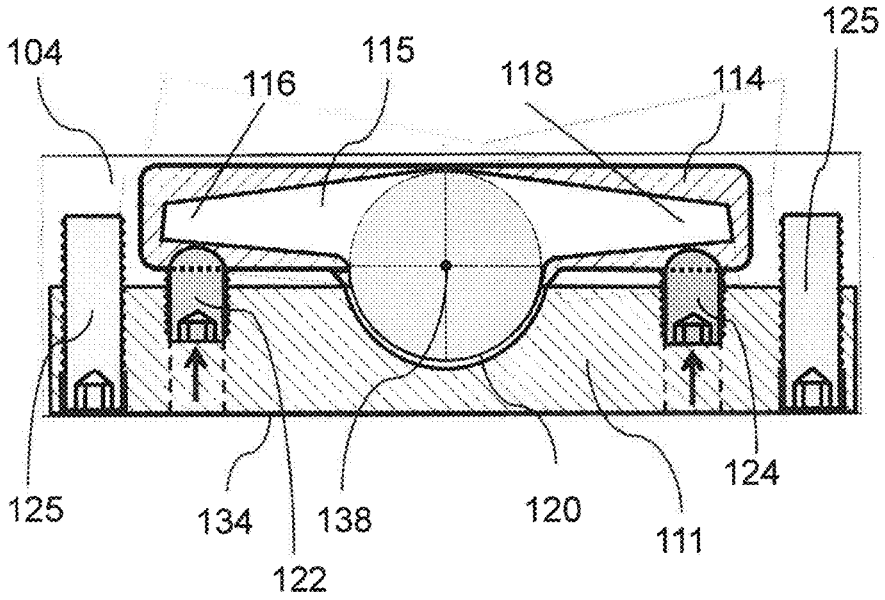
FIG. 8 illustrates an embodiment of a fine adjustment mechanism that facilitates constrained, single-axis adjustability of the shaft angle.

FIG. 8 further illustrates the fine adjustment mechanism that facilitates constrained, single-axis adjustability of the shaft angle within the predefined limits of the $A^{Max}$ and $A^{Min}$. As shown in FIG. 8, the rocker 115 is constrained on the upper bounds by the upper surface of the cavity 114 and on the lower bounds by the retaining plate 111, which is detachably affixed to the body 104 by any conventional means of attachment such as the depicted shoulder screws 125, or any other suitable fastening means such as screws or the like. Once constrained on the upper and lower bounds, the rocker 115 is only free to rotate within the bounds of the cavity 114 about the center pivot 138. The rotation is constrained in this embodiment by the rocker arms 116, 118 as they contact the adjustors 122, 124 and/or the upper surface of the cavity 114. Once the ideal shaft angle A is determined for an individual, the angle is set by setting the depth of the heal and/or toe adjustors 122, 124 so that the rocker 115 is rigidly held in place.

Figure 9:
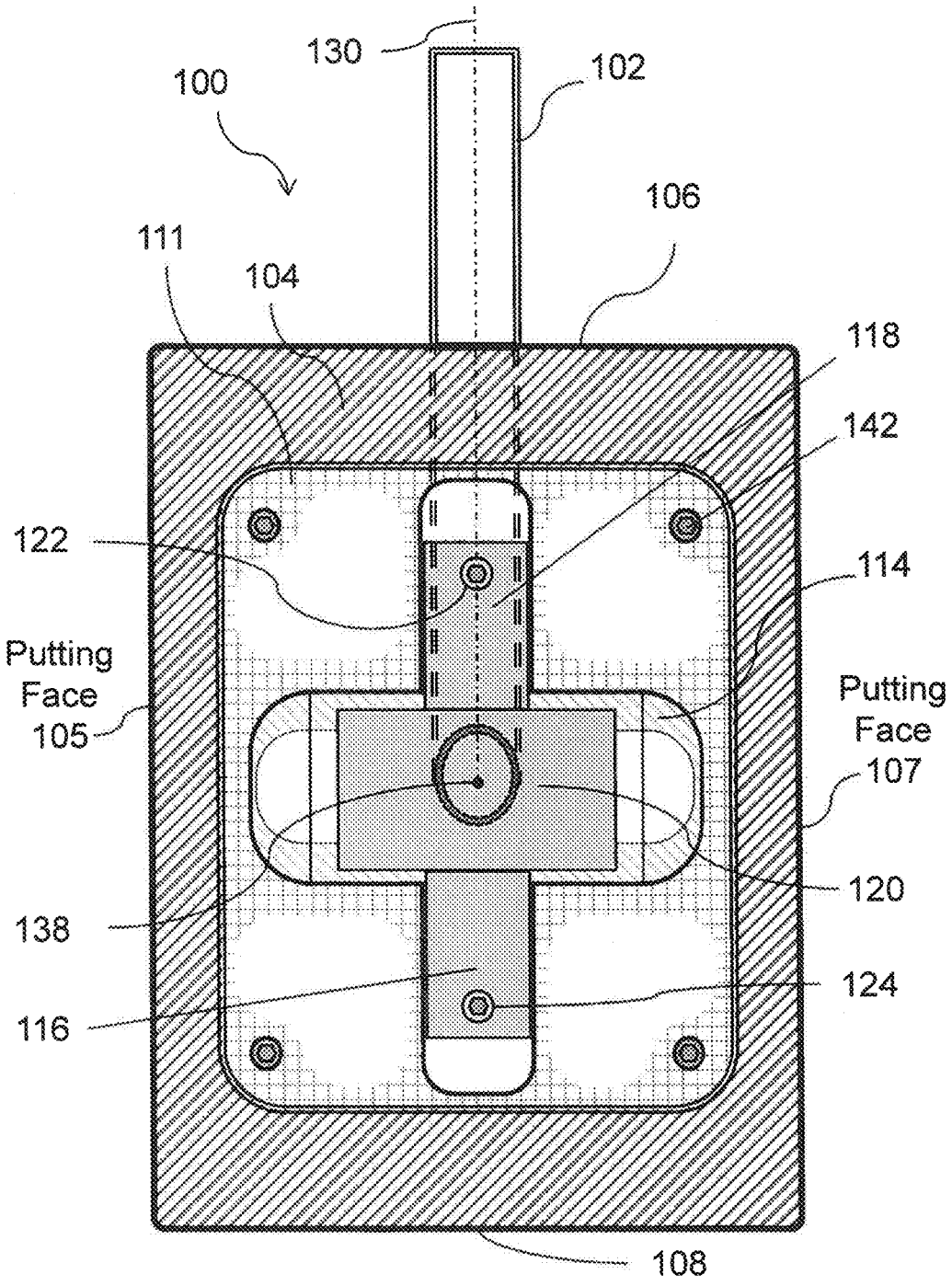
FIG. 9 is a bottom view of the embodiment of FIG. 8 illustrating the adjustment mechanism that facilitates constrained, single-axis adjustability of the shaft angle.

FIG. 9 is a bottom view of the embodiment of FIG. 8 illustrating the adjustment mechanism that facilitates constrained, single-axis adjustability of the shaft angle. As detailed in FIG. 9, the putter embodiments shown are symmetrical and have the ability to be utilized as left-handed or right-handed, with putting face 105 as shown used as a right-handed club and putting face 107 as shown used as a left-handed club. As shown, the rocker 115 is constrained within the cavity 114 and retained in place with the retaining plate 111, which is attached to the body 104 with four retaining shoulder screws 125. With the retaining plate 111 attached in place, the rocker 115 is constrained to move only by rotating about its pivot center 138, and limited in this rotation by the rocker arms 116, 118. This constrained adjustability of the rotation of the rocker 115 is fixated to a determined position for the user by setting the position of the heel and toe adjustors 122, 124.

Figure 10:
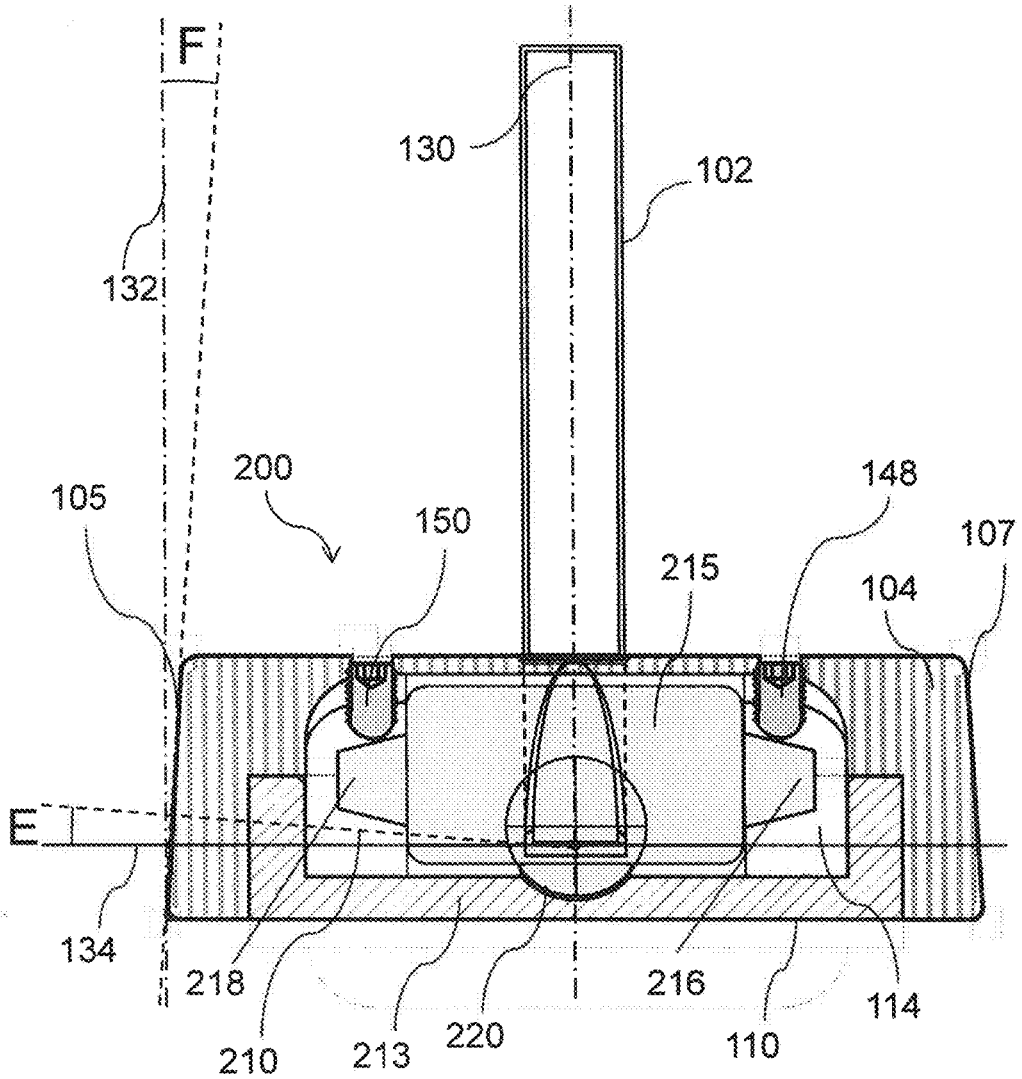
FIG. 10 illustrates an embodiment of a golf putter with 2-axis, constrained, adjustability.

FIG. 10 illustrates an embodiment of a golf putter clubhead 200 with 2-axis, independent, constrained, adjustability. As shown in the cross-sectional frontal plane view, this embodiment demonstrates a golfing putter with constrained adjustability of the loft angle F, the angle between the club's putting face 105, 107 and the vertical plane 132, which also can be measured as angle E from the parallel line 210 of the sole 110 of the club to the horizontal plane 134. It is loft that is the primary determinant of the trajectory of the golf ball when struck by the club and is typically very nearly zero in putting clubs.

The 2-axis rocker 215 retained by the retaining plate 213 and pivots within the cavity 114 as did the aforementioned embodiments, but the rocker pivot 220 of FIG. 10 contains a semi-spherical protrusion rather than a cylindrical pivot, thereby allowing an additional degree of freedom to the constrained adjustment. This allows the loft angle F to be adjusted in a similar manner to the shaft angle A. As shown, the 2-axis rocker 215 comprises two additional rocker arms 216, 218 that are precisely set within the minimum and maximum adjustability constraints using in this embodiment hex-head screw adjustments 148, 150. Thus in the detailed embodiment, the loft (angle F) and the lie (realized as shaft angle A) are each easily adjusted within constraints to fit the individual anthropometric and swing characteristics of a particular user while conforming to current and proposed USGA rules. As shown, the embodiment of FIG. 10 may be used and adjusted for a right or left-handed swing and may or may not contain adjustment for the lie angle.

Figure 11:
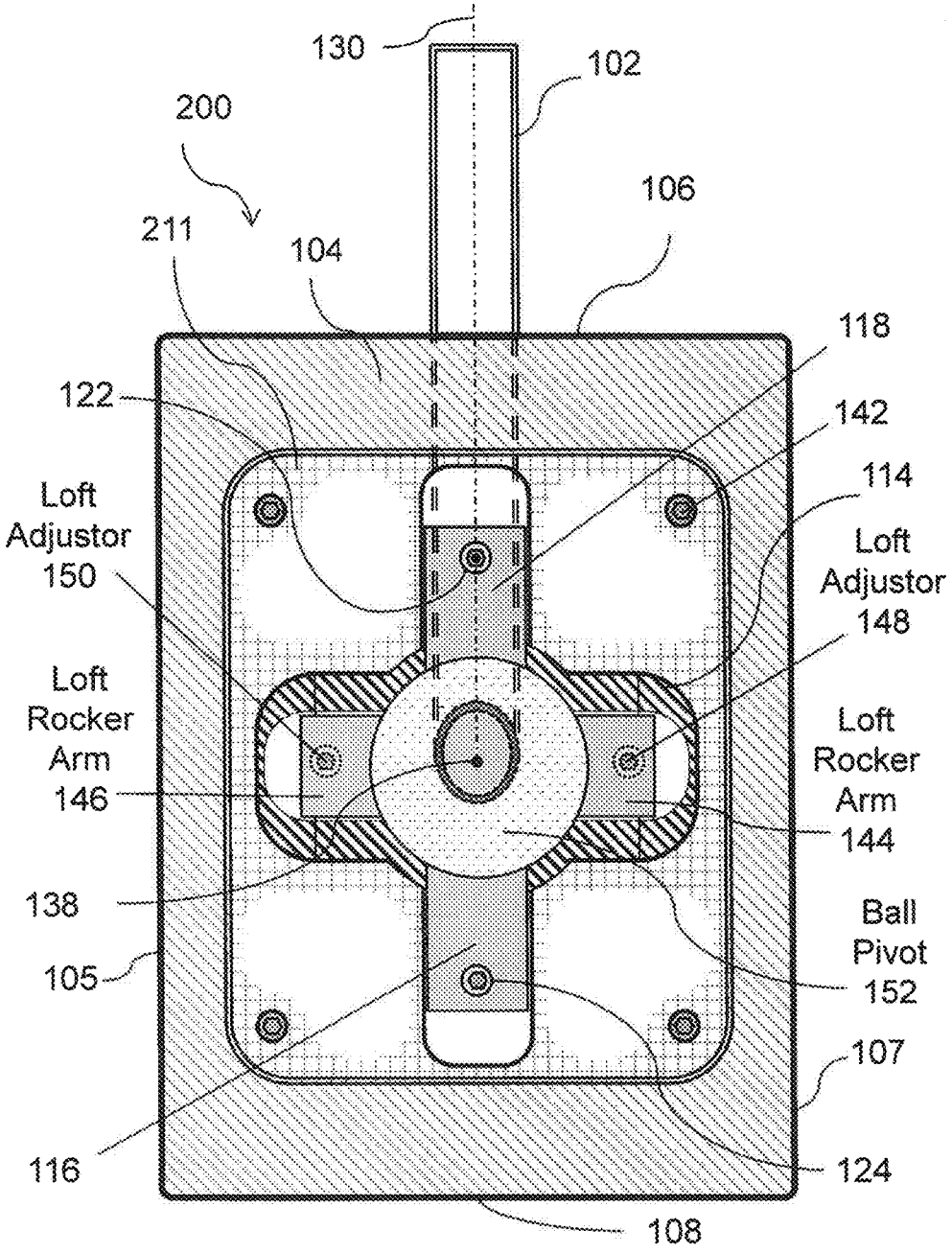
FIG. 11 is a bottom view of the embodiment of FIG. 10 illustrating the adjustment mechanism that facilitates constrained, 2-axis adjustability.

FIG. 11 is a bottom view of an embodiment illustrating the adjustment mechanism that facilitates independent, constrained, 2-axis adjustability for a clubhead 200. As demonstrated in this embodiment, the lie and loft of the club are each constrained within specified limits and fine adjustments are made within these limits utilizing adjustment screws. The loft angle F is set by adjustment and positioning the loft rocker arms 144, 146 utilizing the loft adjustor screws 148, 150, while the lie (realized as shaft angle A) is set by adjustment and positioning the heel and toe rocker arms 116, 118 utilizing the heel and toe adjustor 122, 124 adjustor screws. The retaining plate 211 id secured to the body 104 utilizing four retaining fasteners 142 (in this embodiment, hex head shoulder screws).

For example, the clubhead 100 depicted in FIG. 2, may be manufactured such that the lengths and geometry of the rocker arms 116, 118 with respect to the cavity 114 allow limited clearance such that the straight part of the shaft 102 on to the vertical plane 132 through the toe and heel must diverge from the vertical (minimum shaft angle $A^{Min}$) by a specified amount such as at least 5 degrees, or at least 10 degrees, or at least 25 degrees or by at least any amount between 10 and 25 degrees, by at least any amount between 0 and 45 degrees when the club is in its normal address position. Similarly, limited clearance such that the straight part of the shaft 102 on to the vertical plane 132 through the toe and heel may diverge from the vertical (maximum shaft angle $A^{Max}$) by a specified amount such as no more than 5 degrees, or no more than 10 degrees, or no more than 25 degrees or by no more than any amount between 10 and 25 degrees, by no more than any amount between 0 and 45 degrees when the club is in its normal address position.

As another example, the clubhead 200 depicted in FIG. 10, may be manufactured such that the lengths and geometry of the rocker arms 216, 218 with respect to the cavity 114 allow limited clearance such that angle F of the putting face 105 or 107 to the vertical plane 132, may not diverge from the vertical by more or less than a specified amount. Such positive loft examples may include, but are not limited to a loft of +3 degrees, or +5 degrees, or +10 degrees or by any amount between 0 and +5 degrees, by any amount between 0 and +10 degrees, or so that the loft of the putter may have any angle such that it not exceed +10 degrees when the club is in its normal address position. Similarly, the clubhead 200 may be adjusted to have a negative loft whose examples may include, but are not limited to a loft of −3 degrees, or −5 degrees, or −10 degrees or by any amount between 0 and −5 degrees, by any amount between 0 and −10 degrees, or so that the loft of the putter may have any angle such that it not exceed −10 degrees when the club is in its normal address position.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

The invention claimed is:

1. An adjustable golf club comprising:

a golf club shaft;

a clubhead comprising:

a hollow body wherein a bottom surface of said body defines an upper boundary confine of a cavity with said hollow body, and a top surface of said body provides a crown with an opening disposed on said crown such that a proximal end of said club shaft is able to protrude through said opening;

a retaining plate that attaches to said body wherein a top surface of said plate defines the lower boundary confine of said cavity with said hollow body, and a bottom surface of said plate provides a sole;

a rocker member disposed within said cavity comprising:

a cylindrical rocker pivot that allows the assembly to rotate about a pivot center;

a toe rocker arm that extend forward from a pivot center;

a heel rocker arm that extends rearward from said pivot center; and, a cylindrical bore that extends from a top portion into said rocker member to retain a distal end of said club shaft;

wherein the confines of said cavity allow said rocker member limit single plane rotation about said pivot center constrained by interference between said rocker arms and the confines of said cavity at minimum and maximum angular limits; and, a lie adjustor that facilitates adjustment of the rotational position of said rocker member in a plane parallel to a striking face of said golf club within said constraints of said rocker arm interference and rigidly locks the rotation of said rocker member in place between said minimum and maximum angular limits to establish a club lie angle.

2. The adjustable golf club of claim 1, wherein said body further comprises:

a heel portion extending downwardly from said crown on a side of said body that makes an acute angle with a club shaft axis, and a toe portion extending downwardly from said crown on an opposing side.

3. The adjustable golf club of claim 1, wherein said lie adjustor further comprises:

a heel adjuster comprising a threaded set-screw that contacts a surface of said heel rocker arm and a toe adjuster comprising a threaded set-screw that contacts a surface of said toe rocker arm to restrict torque in said rocker pivot and perform said rigid rotational lock.

4. The adjustable golf club of claim 1, wherein said minimum angular limit is 10 degrees.

5. The adjustable golf club of claim 1, wherein said minimum angular limit is 25 degrees.

6. The adjustable golf club of claim 1, wherein said maximum angular limit is 25 degrees.

7. The adjustable golf club of claim 1, wherein said clubhead further comprises:

a second striking face parallel to said striking face on an opposing side of said clubhead and disposed such that said club is able to be used with a left-handed or a right-handed swing.

8. An adjustable golf club comprising:

a golf club shaft with a proximal grip and a distal end that is connected to a rocker member comprising one or more rocker arm protrusions, said rocker member that is confined within a cavity inside a hollow clubhead such that said rocker member is able to rotate within said cavity in a single plane parallel to a striking face of said golf club about a pivot center, said rotation that is limited to a constrained rotational arc, the angular limits of which are determined by said rocker arm protrusions that extend outwardly in said plane from said pivot center and interfere with the confines of said cavity at minimum and maximum angular limits; and, a lie adjustor that facilitates adjustment of the rotational position of said rocker member in a plane parallel to a striking face of said golf club within said constraints of said rocker arm interference and rigidly locks the rotation of said rocker member in place between said minimum and maximum angular limits to establish a club lie angle.

9. The adjustable golf club of claim 8, wherein said lie adjustor further comprises:

a heel adjuster comprising a threaded set-screw that contacts a surface of said heel rocker protrusion and a toe adjuster comprising a threaded set-screw that contacts a surface of said toe rocker protrusion to restrict torque in said rocker pivot and perform said rigid rotational lock.

10. The adjustable golf club of claim 8, wherein said minimum angular limit is 10 degrees.

11. The adjustable golf club of claim 8, wherein said minimum angular limit is 25 degrees.

12. The adjustable golf club of claim 8, wherein said maximum angular limit is 25 degrees.

13. The adjustable golf club of claim 8, wherein said clubhead further comprises:

a second striking face parallel to said striking face on an opposing side of said clubhead and disposed such that said club is able to be used with a left-handed or a right-handed swing.

* * * * *